US007588096B2

(12) United States Patent
Panasik

(10) Patent No.: US 7,588,096 B2
(45) Date of Patent: Sep. 15, 2009

(54) CORDLESS FASTENER TOOL WITH FASTENER DRIVING AND ROTATING FUNCTIONS

(75) Inventor: Cheryl L. Panasik, Elburn, IL (US)

(73) Assignee: Illinois Tool Works Inc., Glenview, IL (US)

( * ) Notice: Subject to any disclaimer, the term of this patent is extended or adjusted under 35 U.S.C. 154(b) by 33 days.

(21) Appl. No.: 11/965,473

(22) Filed: Dec. 27, 2007

(65) Prior Publication Data

US 2008/0156842 A1 Jul. 3, 2008

Related U.S. Application Data

(60) Provisional application No. 60/877,983, filed on Dec. 29, 2006.

(51) Int. Cl.
*B25B 21/02* (2006.01)

(52) U.S. Cl. ..... 173/108; 173/4; 173/105; 173/209; 227/10; 227/139; 81/57.44; 81/434

(58) Field of Classification Search ..... 173/48, 173/105, 109, 104, 108, 209, 4, 11, 13; 227/10, 227/130, 138; 81/434, 470, 57.13, 57.3, 81/57.44

See application file for complete search history.

(56) References Cited

U.S. PATENT DOCUMENTS 3,403,738 A * 10/1968 Hitt et al. ..... 173/48
3,497,124 A 2/1970 Temple et al.
3,584,695 A * 6/1971 Turnbull ..... 173/107
3,603,406 A * 9/1971 Kahn ..... 173/108
4,094,365 A 6/1978 Wanner
4,403,722 A 9/1983 Nikolich
4,483,474 A * 11/1984 Nikolich ..... 227/8
4,581,964 A * 4/1986 Takatsuru ..... 81/464
4,609,053 A 9/1986 Ragnmark
5,161,624 A * 11/1992 Beck et al. ..... 173/47
5,280,673 A * 1/1994 Zieve et al. ..... 29/718
5,862,724 A 1/1999 Arata et al.
5,996,874 A * 12/1999 Fukushima et al. ..... 227/8
6,145,724 A 11/2000 Shkolnikov et al.
6,205,894 B1 * 3/2001 Tanaka ..... 81/470
6,558,127 B2 5/2003 Maruyama et al.
6,843,400 B1 * 1/2005 Lee ..... 227/8
6,938,811 B2 * 9/2005 Ehmig et al. ..... 227/10
7,021,511 B2 4/2006 Popovich et al.
7,032,683 B2 * 4/2006 Hetcher et al. ..... 173/1
7,040,521 B2 5/2006 Kolodziej et al.
2005/0167464 A1 8/2005 Akiba

* cited by examiner

*Primary Examiner*—Scott A. Smith
(74) *Attorney, Agent, or Firm*—Greer, Burns & Crain, Ltd.; Mark W. Croll; Christopher P. Rauch

(57) ABSTRACT

A fastener-driving tool includes a combustion power source configured for driving a driver blade linearly towards a workpiece, and an electrical power source associated with the combustion power source for rotationally driving the driver blade upon completion of the linear travel, both power sources being disposed in the tool.

20 Claims, 3 Drawing Sheets

CORDLESS FASTENER TOOL WITH FASTENER DRIVING AND ROTATING FUNCTIONS

RELATED APPLICATION

The present application claims priority under 35 USC § 119(e) from U.S. Ser. No. 60/877,983 filed Dec. 29, 2006.

BACKGROUND

The present invention relates generally to fastener-driving tools used to drive fasteners into workpieces, and specifically to combustion-powered fastener-driving tools, also referred to as combustion tools or combustion nailers.

Combustion-powered tools are known in the art. Representative tools are manufactured by Illinois Tool Works, Inc. of Glenview, Ill. for use in driving fasteners into workpieces, and are described in commonly assigned patents to Nikolich U.S. Pat. Re. No. 32,452, and U.S. Pat. Nos. 4,522,162; 4,483,473; 4,483,474; 4,403,722; 5,133,329; 5,197,646; 5,263,439 and 6,145,724 all of which are incorporated by reference herein.

Such tools incorporate a tool housing enclosing a small internal combustion engine or power source. The engine is powered by a canister of pressurized fuel gas, also called a fuel cell. A battery-powered electronic power distribution unit produces a spark combustion within the chamber, while facilitating processes ancillary to the combustion operation of the device. Such ancillary processes include: mixing the fuel and air within the chamber; turbulence to increase the combustion process; scavenging combustion by-products with fresh air; and cooling the engine. The engine includes a reciprocating piston with an elongated, rigid driver blade disposed within a cylinder body.

A valve sleeve is axially reciprocable about the cylinder and, through a linkage, moves to close the combustion chamber when a work contact element at the end of the linkage is pressed against a workpiece. This pressing action also triggers a fuel-metering valve to introduce a specified volume of fuel into the closed combustion chamber.

Upon the pulling of a trigger switch, which causes the spark to ignite a charge of gas in the combustion chamber of the engine, the combined piston and driver blade is forced downward to impact a positioned fastener and drive it into the workpiece. The piston then returns to its original or pre-firing position, through differential gas pressures within the cylinder. Fasteners are fed magazine-style into the nosepiece, where they are held in a properly positioned orientation for receiving the impact of the driver blade. Upon ignition of the combustible fuel/air mixture, the combustion in the chamber causes the acceleration of the piston/driver blade assembly and the penetration of the fastener into the workpiece if the fastener is present.

Such tools are typically employed with nails, brads, or similar fasteners designed for being axially or linearly driven into a workpiece. While these tools have been widely accepted for use in rough framing as well as finish construction, users have been forced to use other tools for installing wallboard to frame members such as metal or wooden studs. In the latter operations, performed on exterior as well as interior construction, users employ corded or cordless drills or fastener drivers for rapidly applying threaded fasteners through the wallboard and into the frame member.

One installation factor dealt with by wallboard installers is that, upon driving, the generally large diameter head of the fastener should be flush with, but not pierce the face paper outer layer of the wallboard. If the fastener passes through the face paper, the board is structurally weakened at that point, and may require additional finishing.

Another installation factor of wallboard installation is that when wallboard is applied to metal frame members, the fastener typically easily passes through the wallboard, but in some cases has difficulty penetrating the frame member. Even when special cutting or drill tip type fasteners are used, the frame member is pushed away from a rear surface of the wallboard. This type of condition has been experienced when combustion tools drive unthreaded fasteners are used to fasten wallboard to frame members, and also when conventional power drills are used to drive wallboard screws. Thus, in some cases, the fastener pierces the frame member on an angle relative to the wallboard. Subsequent tightening of the fastener by the power applicator tool fails to form a tight connection between the wallboard and the frame member at that point.

U.S. Pat. No. 5,862,724 discloses a pneumatic fastener driving tool having both linear and rotational fastener driving functions. One drawback of this tool is that, being pneumatically powered; it requires a remote compressor connected to the tool with a pressure hose. Such hoses are bulky and awkward to work around in many workplaces. Compressors are noisy and cannot always be used indoors. Another drawback of the disclosed tool is that it has insufficient power to drive fasteners into metal frame members. Still another drawback of the disclosed tool is that as the driver blade forces the fastener against the metal frame member, the pneumatic impact force generates recoil which causes a fastener-driving bit at the end of the driver blade to become disengaged from the fastener head. In such cases, a separate tool such as a power screwdriver is needed to complete fastener installation.

Thus, there is a need for a fastener driving tool which addresses the above-identified drawbacks of conventional tools.

BRIEF SUMMARY

The above-listed needs are met or exceeded by the present fastener-driving tool which overcomes the limitations of the current technology. In the present tool, pneumatic power is replaced by a combustion power source, eliminating the need for a separate compressor and pressure hose. Thus, the present tool is completely portable. The present tool is provided with a combustion engine for driving the fastener into the workpiece, and an electric motor for rotating the driver blade and the engaged fastener. In addition, the combustion power source provides greater driving force than the prior art pneumatic tool. Also, the present tool controls the combustion-generated driver blade recoil so that the driver blade maintains engagement with the fastener during the rotation phase of the installation process. When used with cutting tip threaded fasteners, wallboard installation time is reduced, and wallboard is more securely attached to the frame members.

More specifically, a fastener-driving tool includes a combustion power source configured for driving a driver blade to linearly travel towards a workpiece, and an electrical power source associated with the combustion power source for rotationally driving the driver blade upon completion of the linear travel, both power sources being disposed in the tool.

In another embodiment, a fastener-driving tool includes a housing, a combustion power source disposed in the housing and including a cylinder head, a cylinder, a piston reciprocating within the cylinder between upper and lower cylinder ends, and a driver blade connected to the piston configured for linearly driving a driver blade towards a workpiece. An electrical power source is associated with the combustion power source for rotationally driving the driver blade upon the piston reaching the lower cylinder end.

DETAILED DESCRIPTION

Figure 1:
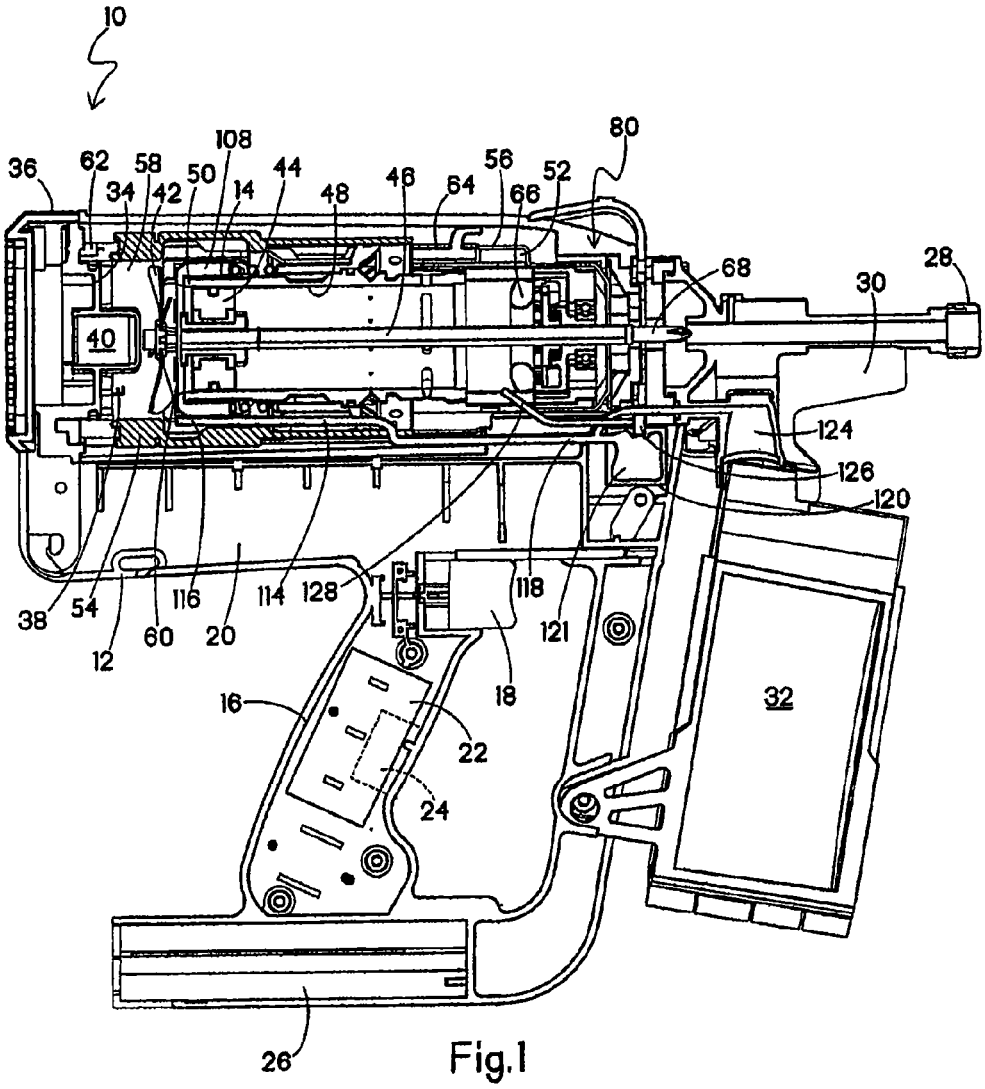
FIG. 1 is a vertical cross section of a fastener-driving tool incorporating the present combustion and electrical power sources.
Figure 2:
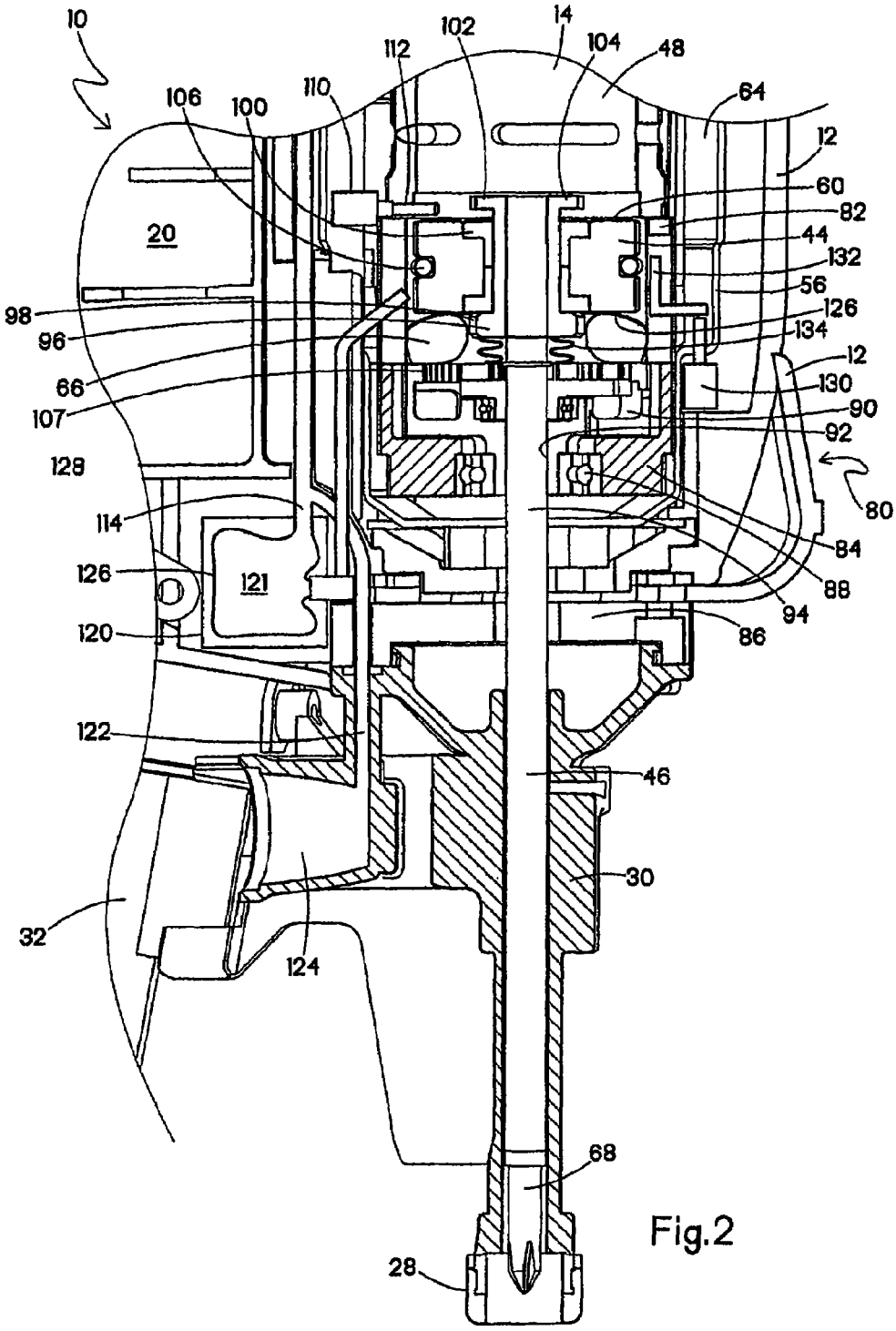
FIG. 2 is an enlarged fragmentary view of the tool in FIG. 1 showing the driver blade in an extended position.

Referring now to FIGS. 1 and 2, a fastener-driving tool or combustion nailer incorporating the present invention is generally designated 10 and preferably is of the general type described in detail in the patents listed above and incorporated by reference in the present application. A housing 12 of the tool 10 encloses a self-contained internal combustion power source 14 as is known in the art. Included on the housing 12 is a handle 16 with a trigger 18. A fuel cell chamber 20 encloses a fuel cell (not shown) which provides pressurized fuel for combustion.

Preferably located within the handle 16, but potentially located elsewhere within the housing 12 is a control system 22 including a central processing unit CPU having a control program 24 (shown hidden). As is known in the art, the control program 24 controls the operation of the tool 10, including fuel delivery if electronic fuel injection is provided, fan rotation when a fan is located within the combustion chamber, and ignition, among other things.

A rechargeable battery (not shown) powers the control program 24 and the control system 22, and is releasably held within a battery chamber 26 located on a side of the housing 12. The battery chamber 26 is configured for slidably accommodating the battery so that contacts of the battery electrically engage corresponding contacts (not shown). Alternatively, it is contemplated that the contacts are connectable, as through a line cord, to a source of alternating current.

Other features of the tool 10 are a workpiece contact element 28 which contacts a workpiece prior to the driving of a fastener, the workpiece contact element constructed to axially slide relative to a nosepiece 30, and having a depth adjustment mechanism (not shown) for adjusting the relative spacing of the workpiece contact element 28 to the nosepiece for adjusting the depth of fastener insertion by the tool 10. A fastener magazine 32 is provided for storing a supply of fasteners (not shown), and is shown connected to the nosepiece 30. While a rotary magazine 32 is depicted, other magazine configurations are contemplated, including but not limited to linearly operating or strip magazines being part of the housing 12.

As is known in combustion nailers, the power source 14 includes a cylinder head 34 located at a first end 36 of the housing 12, including a spark plug 38, and a fan motor 40 powering a fan 42.

A piston 44 connected to a driver blade 46 reciprocates within a cylinder 48 having a first or upper end 50 and a second or lower end 52. A valve sleeve 54 surrounds and is slidable relative to the cylinder 48. Connected to the workpiece contact element 28 by a linkage 56 referred to as an upper probe, the valve sleeve 54 is biased out of engagement with the cylinder head 34 by a spring (not shown).

A combustion chamber 58 is defined by the cylinder head 34, the valve sleeve 54, an upper end 60 of the piston 44 and the first end 50 of the cylinder 48. The fan 42 projects into the combustion chamber 58 and performs functions identified above and well known in the art. A chamber switch 62 (FIG. 1, sometimes referred to as a head switch) is located in proximity to the valve sleeve 54 to monitor its positioning.

Depression of the tool housing 12 against a workpiece (not shown) towards the right as seen in FIG. 1 (other operational orientations are contemplated as are known in the art), causes the workpiece contact element 28 to move relative to the tool housing 12 from a rest position to a firing position. This movement overcomes the normally downward (or rightward as seen in FIG. 1) biased orientation of the workpiece contact element 28.

Through the linkage 56, the workpiece contact element 28 is connected to, or in contact with, and reciprocally moves with, the valve sleeve 54. In the rest position (FIG. 1), the combustion chamber 58 is not sealed, since there are gaps separating the valve sleeve 54 and the cylinder head 34, and a lower gap separating the valve sleeve and the cylinder 48.

Upon closing of the combustion chamber 58 to ambient through the pressing of the tool 10 against a workpiece, the chamber switch 62 is closed. A dose of fuel is introduced into the combustion chamber 58, and the fan 42 rotates to circulate the fuel/air mixture within the chamber. Upon depression of the trigger 18 and actuation of an associated trigger switch (not shown, the terms trigger and trigger switch are used interchangeably), a user induces combustion of the fuel/air mixture in the combustion chamber 58 via the spark plug 38, causing the driver blade 46 to be forcefully driven linearly or axially downward through the nosepiece 30 (FIG. 1). The nosepiece 30 guides the driver blade 46 to strike a fastener that had been delivered into the nosepiece via the fastener magazine 32.

As the piston 44 travels down the cylinder 48, it pushes a rush of air which is exhausted through at least one petal or check valve 64. At the bottom of the piston stroke or the maximum piston travel distance, the piston 44 impacts a resilient bumper 66 as is known in the art. With the piston 44 beyond the exhaust check valve 64, high pressure gasses vent from the cylinder 48 until near atmospheric pressure conditions are obtained and the check valve 64 closes.

Figure 4:
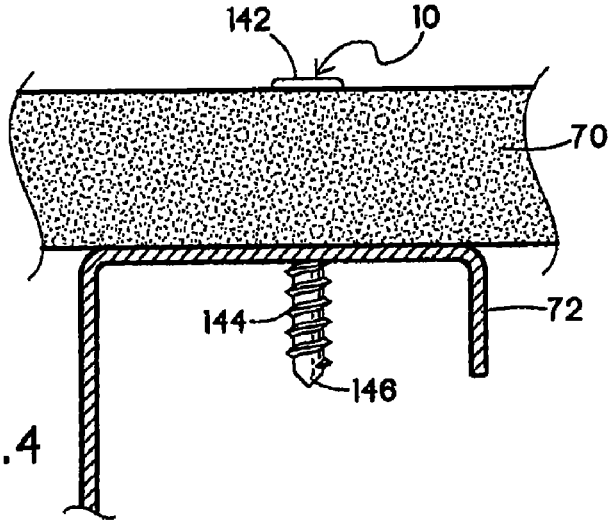
FIG. 4 is a first view of a fastener being properly driven into a metal stud to secure wallboard thereto.

The operational result of the piston reaching the bumper 66 is that a replaceable bit 68 at a tip of the driver blade 46 strips a fastener from the magazine and forces it through the workpiece, preferably a piece of wallboard 70 backed by a frame member 72 (FIG. 4). As is known in the art, the frame member 72 is either made of wood or 12, 14, 16, 18, 20, 22 or 26 gauge steel.

Included in the present tool 10 is an electrical power source, generally designated 80 and associated with the combustion power source 14 preferably but not necessarily within the housing 12 for rotationally driving the driver blade 46 upon completion of the above-described linear or axial travel driven by the combustion power source. In the present application, "in the tool" thus means that the electrical power source 80 as well as the combustion power source 14 are directly movable with the tool 10, and are not remotely connected by hoses, cords or cables.

More specifically, upon the piston 44 reaching the bumper 66, a sensor 82 disposed in operational relationship to the electrical power source 80, senses the presence of the piston. Although in the preferred embodiment the sensor 82 is a proximity sensor which senses the arrival of the piston 44, it is contemplated that other sensors monitoring at least one of pressure, air flow in the cylinder 48, opening of the exhaust valve 64, or the shape of the driver blade 46 can potentially trigger the operation of the power source 80. Preferably a stator motor, the power source 80 includes a fixed stator portion 84. The stator portion 84 is fixed within the housing 12 between the bumper and a plate 86. As is known in the art, the combustion power source 14 is fixed within the housing 12.

A bearing race 88, such as a ball bearing race or the like rotatably supports a rotating armature 90 within the stator portion 84. At the center of the armature 90 is defined an axial opening 92 having a noncircular shape and preferably polygonal, which forms a keyway filled by the driver blade 46. At least a portion 94 of the driver blade 46 is provided with a cross-section which is complementary to the keyway 92 for common rotation.

Connected through the battery in the battery chamber 26 to the control program 24, the power source 80 is triggered by the sensor 82, which is also connected to the control program 24. Upon being triggered by the piston 44, the sensor 82, activates the power source 80, which rotates the driver blade 46 for a predetermined amount of time, a predetermined number of rotations, or until the trigger 18 is released. These rotations cause the fastener to engage the frame member 72 and draw wallboard 70 to the frame member.

Referring now to FIG. 2, the above rotation of the driver blade 46 is achieved through a rotatable relationship to the piston 44. More specifically, an upper end 96 of the driver blade 46 defines a shoulder which receives a washer-like locking plate 98 defining a lower limit of travel of the piston 44. The piston 44 has an inner bushing 100 which slidably and rotationally engages a threaded cap 102 threadably engaging an upper end of the driver blade 46 and having an annular, radially extending flange 104 which defines an upper limit of axial travel of the piston relative to the driver blade. It has been found that by making the piston 44 axially movable relative to the driver blade 46, the driver blade is axially movable for more effective fastener engagement and rotational driving after the piston as reached the lower end 52 of the cylinder 48. Also, the relatively fixed disposition of the electrical power source 80 in the tool 10 absorbs some of the recoil force generated by combustion.

Also, as is well known in the art, the piston 44 is provided with at least one piston ring 106 for maintaining a slidable seal with the cylinder 48. In the event the speed of rotation of the driver blade 46 and the rotating armature 90 needs to be adjusted, a gear reducer 107 is provided to the power source 80.

In conventional combustion tools, due to internal post combustion pressure differentials in the cylinder 48, once the combustion has occurred and the exhaust gases vented, the combustion chamber 58 remains closed and the piston 44 is returned to the pre-firing or rest position shown in FIG. 1. However, in the tool 10, the piston 44 must be retained at the second end 52 of the cylinder 48 until the driver blade rotation and associated fastener driving is completed. In the preferred embodiment, a vacuum valve 108 (FIG. 1) such as a petal valve is located at the first or upper cylinder end 50 for releasing the vacuum in the combustion chamber 58 by introducing ambient air. Thus, the differential gas pressures are eliminated, maintaining the piston 44 near the bumper 66 (FIG. 2).

If desired, the tool 10 is optionally provided with a supplemental locking device 110 which engages the piston 44 and prevents return until fastener driving is complete, or a specified time expires as controlled by the control program 24. Such a locking device 110 is a solenoid with a retractable latch 112 projecting through the cylinder 48 in an energized condition to block piston return.

Upon completion of the operation of the electrical power source and the rotation of the fastener into the workpiece, the piston 44 is returned to the rest position depicted in FIG. 1. If the latch 112 is provided, the control program signals its retraction.

In the preferred embodiment, piston return is facilitated by pressurized exhaust gas diverted through a bypass tube 114 having an upper end 116 in communication with the combustion chamber 58 through an opening in the cylinder 48. Suitable seals such as O-rings, chemical sealant or the like sealingly secure the upper end in place. A lower end 118 is in communication with a gas reservoir 120 preferably containing a compressible bladder 121. The bypass tube 114 is similar in construction and arrangement to that disclosed in U.S. Pat. No. 7,040,521 which is incorporated by reference. In addition, the bypass tube 114 preferably includes a second leg 122 in fluid communication with a magazine advance cylinder 124 for initiating the advance of a fastener into the nosepiece 30 to be ready for the next combustion cycle. While other materials are contemplated, the tube 114 is made of stainless steel, specifically 11 gauge 304 stainless steel, however other equivalent durable heat resistant materials are contemplated.

As is known in the art, the bladder 121 is expandable for retaining pressurized air from the bypass tube 114. Once rotation of the driver blade 46 is completed and piston return is required, the control program 24 actuates a valve 126 in fluid communication with the bladder 121 which releases the stored, pressurized exhaust gas through a piston tube 128 directed against the piston 44 in a way that assists the return of the piston and the driver blade 46 to the rest position.

Referring now to FIG. 2, alternatively to, or in conjunction with the bypass tube 114, a solenoid operated plunger or slide 130 under the control of the control program 24 exerts an impact on the piston 44, optionally through a collar 132, sufficient for causing the piston to return to the rest position. As another alternative, the locking device 110 and the latch 112 are used to hold the piston 44 in position against the force of a return spring 134 located near the bumper 66. Upon completion of rotation of the driver blade 46, the control program 24 releases the latch 112, and causes the compressed return spring 134 to push the piston 44 to the rest position.

Figure 3:
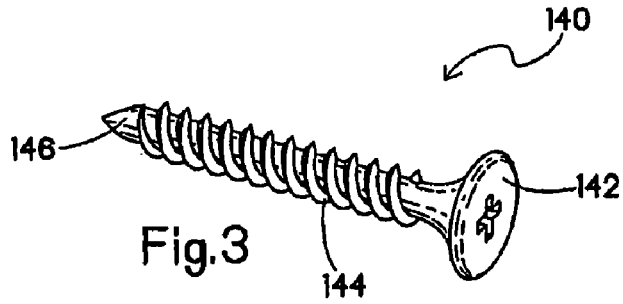
FIG. 3 is an elevational view of a fastener suitable for use with the present tool.

Referring now to FIGS. 2 and 3, the replaceable bit 68 is preferably Phillips, hex, TORX® or similarly shaped to drive conventional power driven fasteners such as a fastener 140, having a head 142 shaped to drivingly engage the bit 68, a threaded shank 144 and a tip 146 as is known in the art. While a representative suitable fastener 140 has been depicted, it will be appreciated that other fastener configurations may be suitable, depending on the application, and including but not limited to conventional fasteners used with power screwdrivers or the like.

Figure 5:
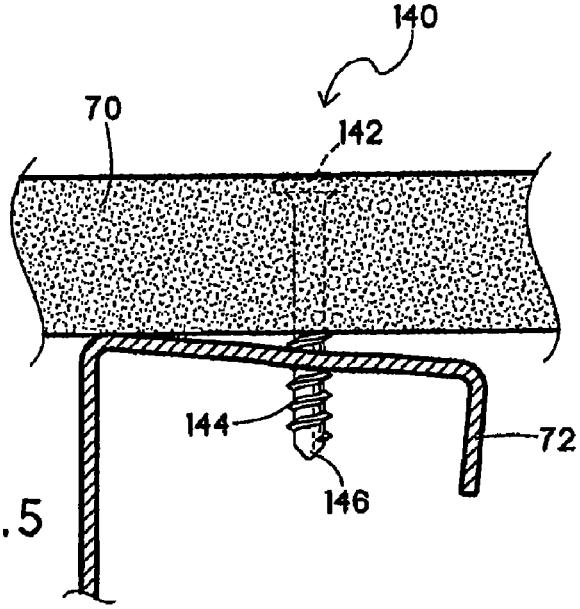
FIG. 5 is a second view of a fastener being improperly driven into a metal stud to secure wallboard thereto.

Referring now to FIGS. 4 and 5, two fastener installation conditions are depicted. In FIG. 4, represented by fasteners driven by the tool 10, the fastener 140 has been driven through the wallboard 70 and into the frame member 72 where sufficient piercing has occurred to allow fastener penetration. As the fastener 140 is rotated by the tool 10, the wallboard 70 and the frame member 72 are drawn together. In FIG. 5, the fastener 140 has pierced the frame member 72, but only after the frame member has been deflected, causing the frame member to be pushed away from the wallboard 70 and potentially causing a loose wallboard installation. In addition, the deflection of the frame member 72 has caused the fastener head 142 to penetrate the face paper of the wallboard 70, which is undesirable and results in an insecure installation. By providing greater driving power than conventional tools, the present tool 10 avoids the situation depicted in FIG. 5.

While a particular embodiment of the present cordless fastener tool with fastener driving and rotating functions has been described herein, it will be appreciated by those skilled in the art that changes and modifications may be made thereto without departing from the invention in its broader aspects and as set forth in the following claims.

The invention claimed is:

1. A fastener-driving tool, comprising:

a combustion power source configured for driving a driver blade to linearly travel towards a workpiece; and an electrical power source associated with said combustion power source for rotationally driving said driver blade upon completion of said linear travel, both said power sources being disposed in the tool.

2. The tool of claim 1, further including a piston reciprocating relative to a cylinder, a driver blade connected to said piston and configured for engaging and driving a fastener into a workpiece, said combustion power source driving said piston from a first end of said cylinder to a second end, said electrical power source rotating said driver blade upon said piston reaching said second end.

3. The tool of claim 2, wherein said driver blade is rotatable and axially displaceable relative to said piston.

4. The tool of claim 3, further including said driver blade including upper and lower stops defining axial limits of travel of said piston.

5. The tool of claim 4 wherein said upper stop is defined by a removable piston cap.

6. The tool of claim 2, further including a bumper in said cylinder disposed for receiving said piston as it is driven toward said second end, said bumper being located between said electrical power source and said first end of said cylinder, said electrical power source being a stator motor.

7. The tool of claim 6 wherein said stator motor and a portion of said driver blade are complementarily keyed for common rotation.

8. The tool of claim 1, wherein said electrical power source is provided with at least one sensor for sensing completion of said linear travel prior to beginning said rotation.

9. The tool of claim 1, wherein said power sources are fixed in said tool relative to each other, with only said driver blade moving axially relative to said power sources.

10. The tool of claim 1 wherein said driver blade has a noncircular cross section in a portion engaged by said electric power source, and said electrical power source is keyed for receiving said driver blade for common rotation.

11. The tool of claim 1 further including a return mechanism for returning said driver blade to an initial position upon completion of said rotation by said electrical power source.

12. The tool of claim 11 wherein said return mechanism uses exhaust gas generated by said combustion power source and diverted so as to exert a return force on said piston.

13. The tool of claim 12 wherein said exhaust gas is also used to power a magazine advance mechanism.

14. The tool of claim 11 wherein said return mechanism is a return spring used in connection with a latch mechanism controlled by a control program.

15. The tool of claim 11 wherein said return mechanism is a solenoid plunger controlled by a control program.

16. A fastener-driving tool, comprising:

a housing;

a combustion power source disposed in said housing and including a cylinder head, a cylinder, a piston reciprocating within said cylinder between upper and lower cylinder ends, and a driver blade connected to said piston configured for linearly driving a driver blade towards a workpiece; and an electrical power source associated with said combustion power source for rotationally driving said driver blade upon said piston reaching said lower cylinder end.

17. The tool of claim 16 wherein said driver blade is rotatable and axially movable relative to said piston.

18. The tool of claim 16 further including a bushing on said piston engaging said driver blade, which includes upper and lower stops defining axial limits of travel of said piston.

19. The tool of claim 18 wherein said upper stop is defined by a removable piston cap.

20. The tool of claim 16 wherein said driver blade is provided with a replaceable bit at an end opposite said piston.

* * * * *